United States Patent [19]

Gatecliff

[11] 3,985,475

[45] Oct. 12, 1976

[54] EXPANSIBLE CHAMBER DEVICE

[75] Inventor: George W. Gatecliff, Saline, Mich.

[73] Assignee: Tecumseh Products Company, Tecumseh, Mich.

[22] Filed: Feb. 20, 1974

[21] Appl. No.: 443,976

[52] U.S. Cl. ..... 417/539; 123/54 A

[51] Int. Cl.[2] ..... F02B 75/26

[58] Field of Search ..... 417/521, 539; 91/197; 74/603; 123/54 R, 54 A, 54 B, 192, 192 B

[56] References Cited

UNITED STATES PATENTS

| | | | |
|---|---|---|---|
| 1,112,287 | 9/1914 | Gunn | 123/54 A |
| 1,911,874 | 5/1933 | Barkeij | 123/54 A |
| 2,010,377 | 8/1935 | Sassen | 417/539 |
| 2,130,529 | 9/1938 | Filicky | 123/54 A |
| 2,284,645 | 6/1942 | Duffy | 417/539 |
| 2,780,404 | 2/1957 | Kuehni | 417/539 |
| 3,046,950 | 7/1962 | Smith | 91/491 |
| 3,817,661 | 6/1974 | Ingalls | 417/902 |

FOREIGN PATENTS OR APPLICATIONS

| | | | |
|---|---|---|---|
| 416,190 | 11/1946 | Italy | 417/539 |

*Primary Examiner*—William L. Freeh
*Attorney, Agent, or Firm*—Barnes, Kisselle, Raisch & Choate

[57] ABSTRACT

An expansible chamber device with offset pistons and a crankshaft having crankpins asymmetrically angularly spaced about its axis of rotation to provide symmetrically spaced peaks in the total torque at the crankshaft throughout each complete revolution thereof.

28 Claims, 13 Drawing Figures

EXPANSIBLE CHAMBER DEVICE

This invention relates to expansible chamber devices and more particularly to multiple cylinder gas pumps and internal combustion engines.

A paper entitled "Effect of Compressor Characteristics on Motor Performance" by Erik H. Jensen which was presented at an ASHRAE meeting in Dallas, Texas, in February, 1960, describes a gas pump having two cylinders arranged in a V at a right angle to each other with the center line of the cylinders intersecting the axis of rotation of the crankshaft and a crankshaft with two crankpins spaced at a right angle to each other to provide two equally spaced impulses or peaks of the total torque per revolution of the crankshaft.

Also known are internal combustion engines each with six cylinders in a V block with each pair of cylinders at a right angle to each other with the center lines of the cylinders intersecting the axis of rotation of a crankshaft having three symmetrically spaced crankpins each operably connected to two pistons received in an associated pair of cylinders. Internal combustion engines have also been proposed or constructed each having a plurality of cylinders alternately disposed on opposed sides of a crankshaft having symmetrically spaced crankpins with the center line of each cylinder offset from the axis of the crankshaft to provide compact engines. Such internal combustion engines in operation produce considerable vibration and noise which, it has been discovered, is due to asymmetrically angularly spaced torque peaks or spikes in each revolution of their crankshafts. Further, it has been found that these undesirable characteristics of such prior expansible chamber devices with offset cylinders can be reduced or eliminated by providing in such devices crankshafts with asymmetrically or unequally spaced crankpins with the spacing selected such that equally or symmetrically spaced peaks of the total torque on the crankshaft are obtained throughout each complete revolution thereof.

Accordingly, objects of this invention are to provide compact offset cylinder expansible chamber devices with decreased vibration and noise in operation, symmetrically spaced torque peaks in each revolution of their crankshafts, and increased overall efficiency in operation, and which are of economical manufacture and assembly.

These and other objects, features and advantages of this invention will be apparent from the following specification, claims and accompanying drawings in which:

Figure 1:
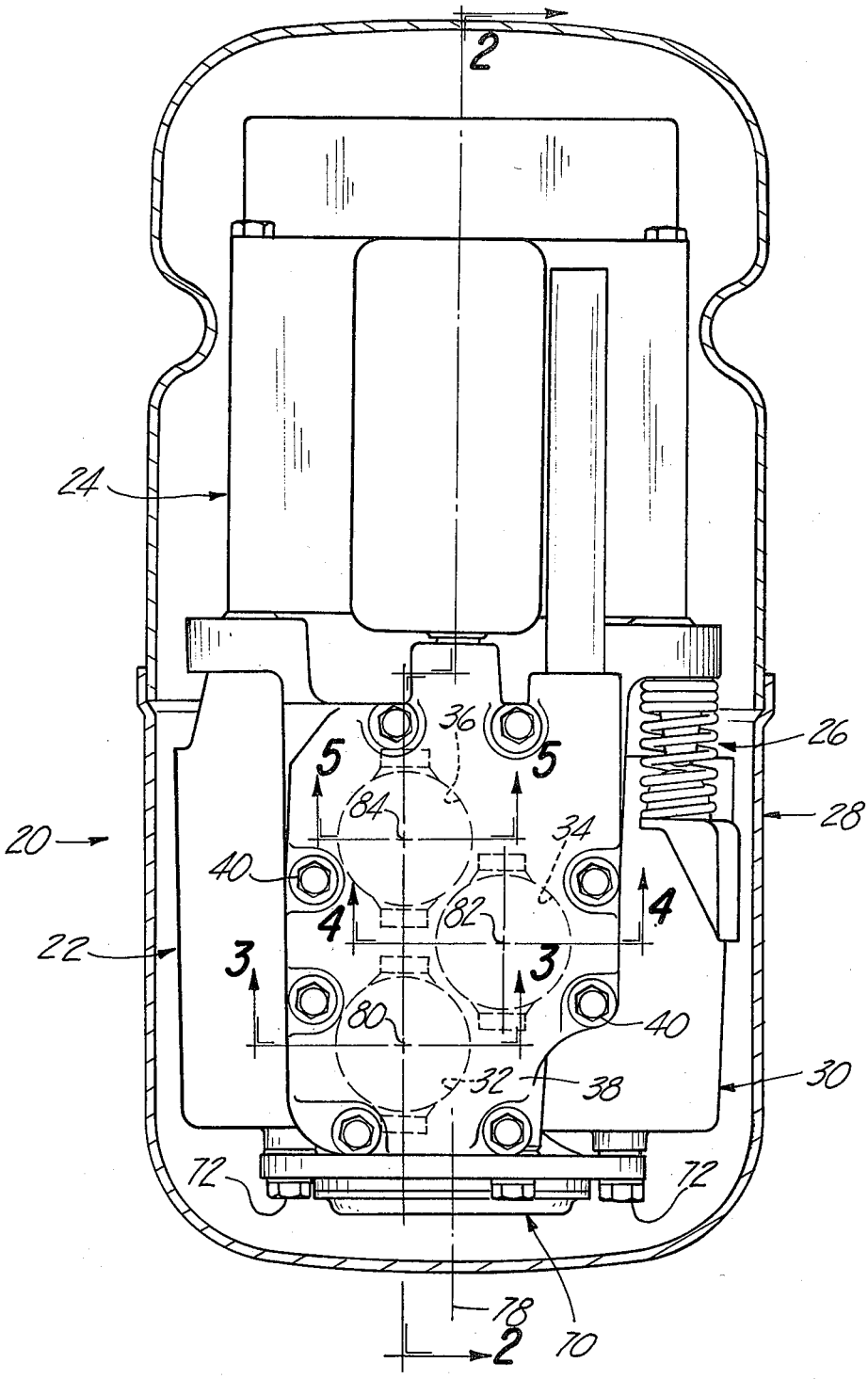
FIG. 1 is a side view of a hermetic compressor embodying this invention with a portion of the outer shell broken away to illustrate the component parts thereof.
Figure 3:
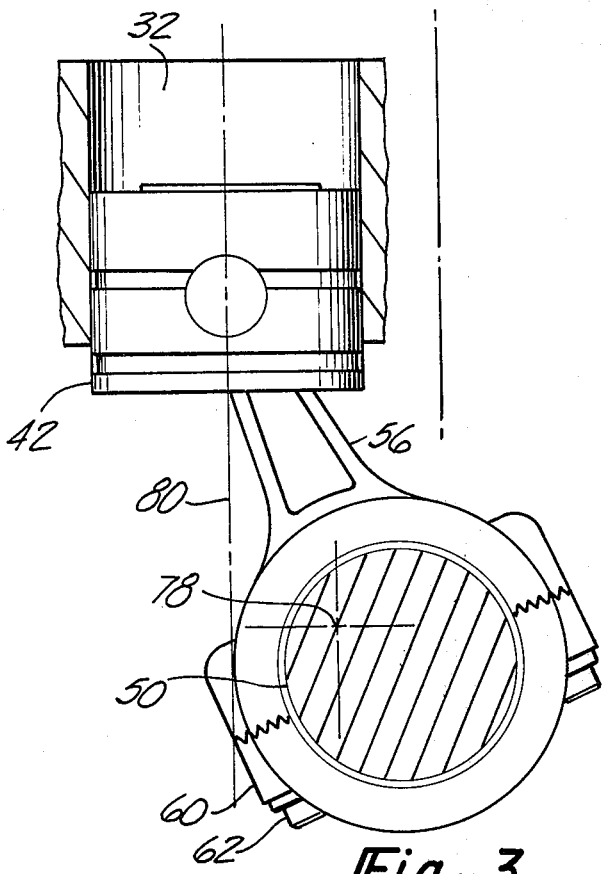
Figure 4:
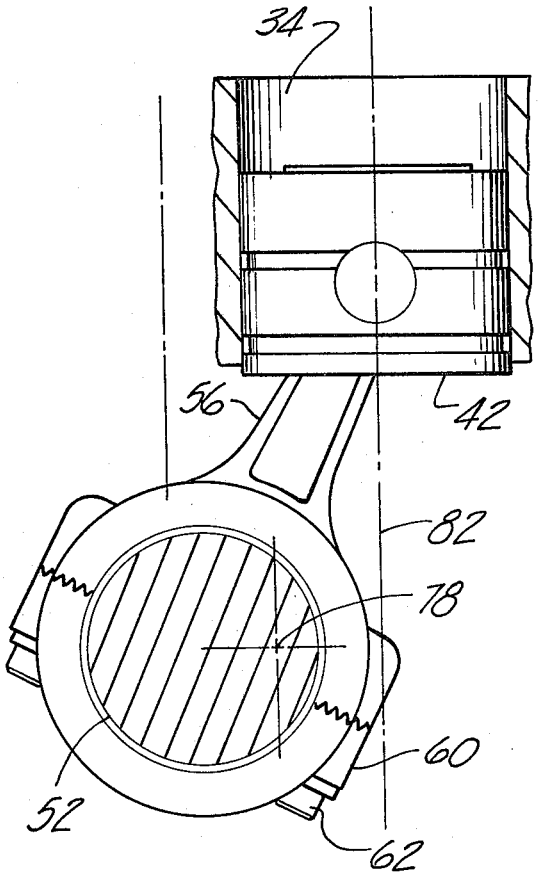
Figure 5:
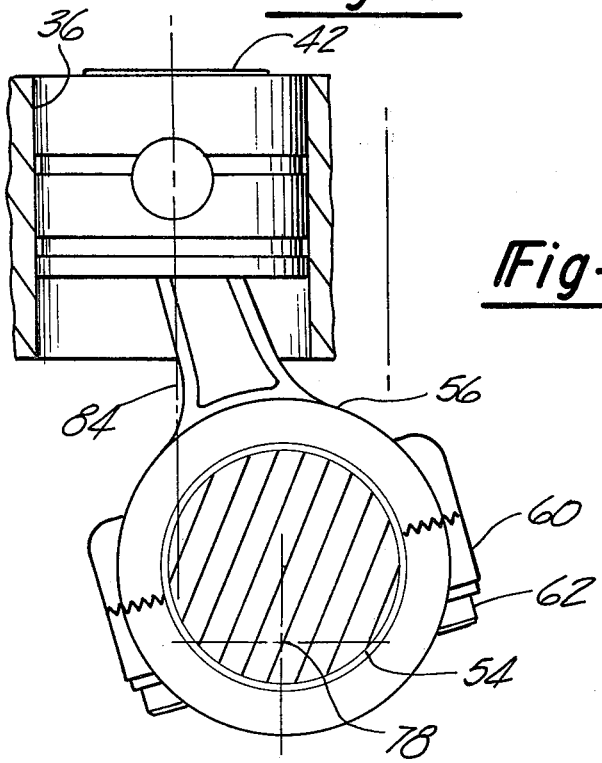

FIGS. 3, 4 and 5 are fragmentary sectional views on lines 3—3, 4—4 and 5—5 respectively of FIG. 1 illustrating the offset of the center line of each of the pistons of the hermetic compressor from the axis of rotation of the crankshaft thereof.

Figure 6:
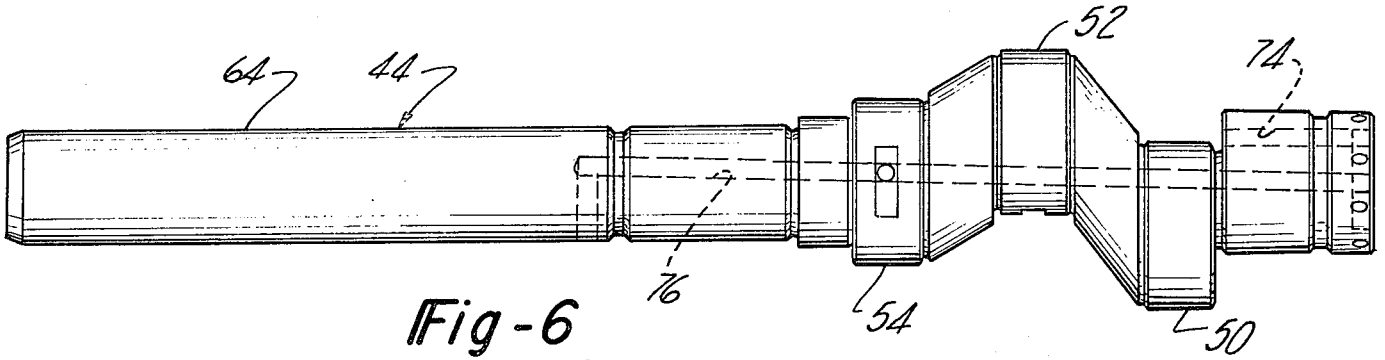
Figure 7:
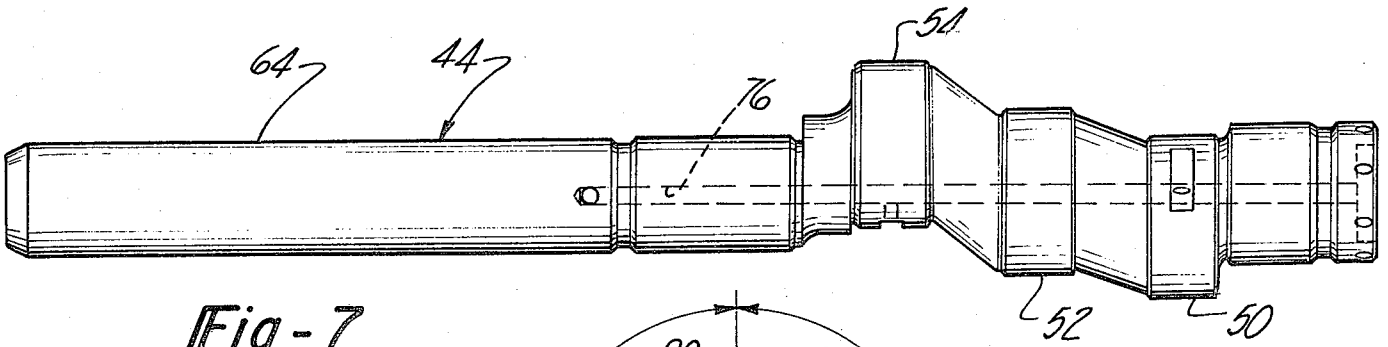
Figure 8:
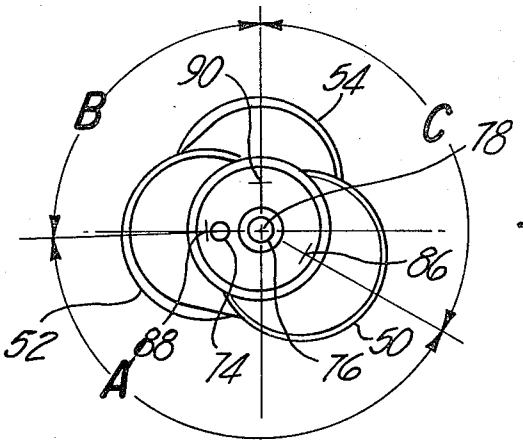

FIGS. 6, 7 and 8 are side, top, and end views respectively of the crankshaft of the hermetic compressor of FIG. 1.

Figure 9:
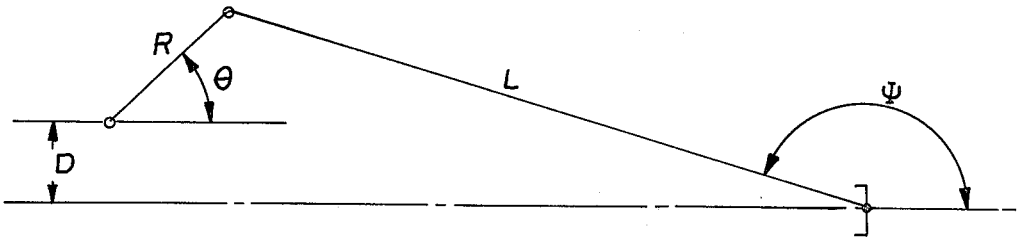

FIG. 9 is a schematic diagram illustrating the geometric relationships of the cylinder, piston, connecting rod, crankpin, and crankshaft of a single cylinder of a gas pump with the piston offset from the axis of rotation of the crankshaft thereof.

Figure 10:
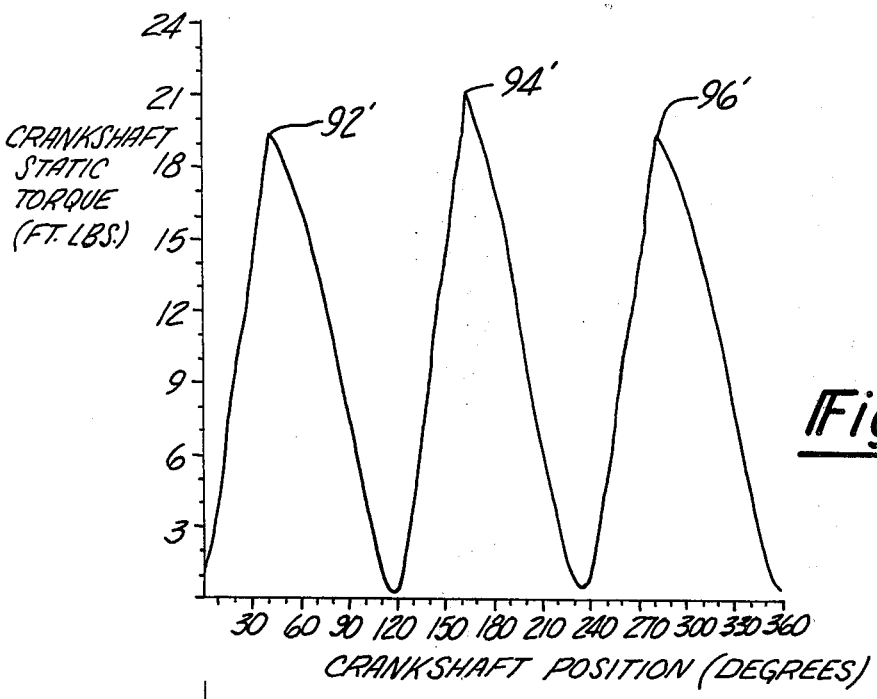

FIG. 10 is a graph of the torque peaks or spikes on the crankshaft during one revolution thereof of the hermetic compressor of FIG. 1.

Figure 11:
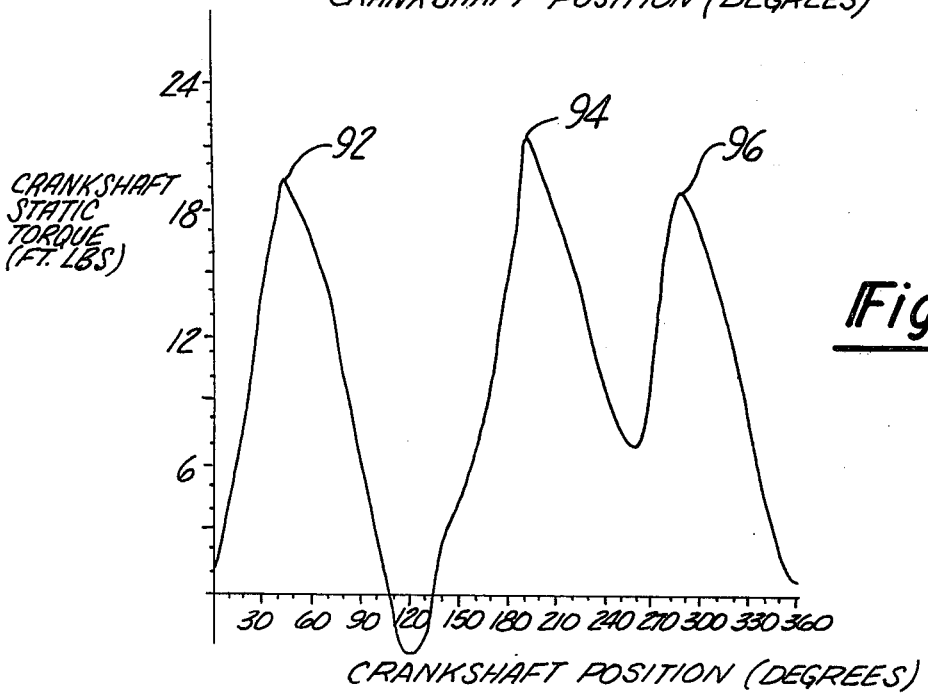

FIG. 11 is a graph of the torque peaks on a crankshaft with symmetrically spaced crankpins during one revolution thereof of a compressor similar to the compressor of FIG. 1.

Figure 12:
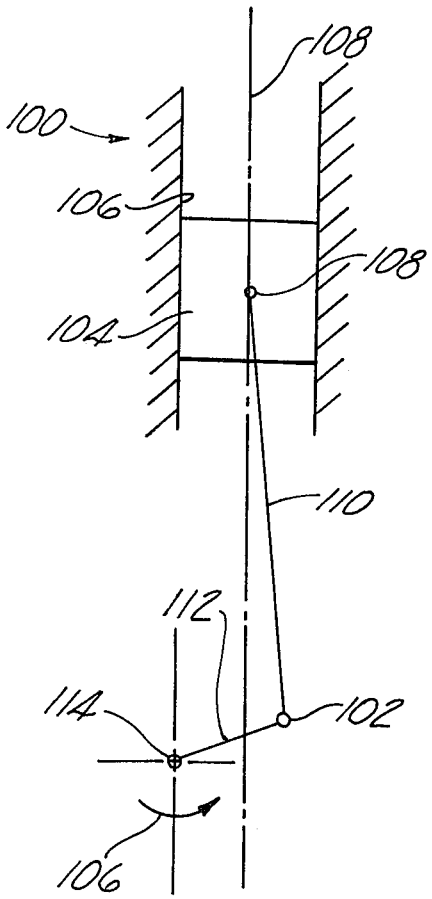

FIG. 12 is a semi-schematic view of one cylinder and associated crankpin of a crankshaft of a multiple cylinder compressor embodying this invention.

Figure 13:
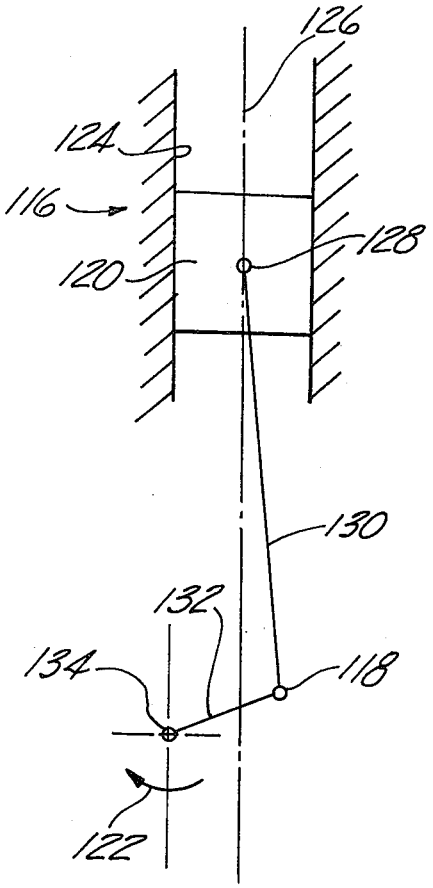

FIG. 13 is a semi-schematic view of one cylinder and associated crankpin of a crankshaft of a multiple cylinder internal combustion engine embodying this invention.

Figure 2:
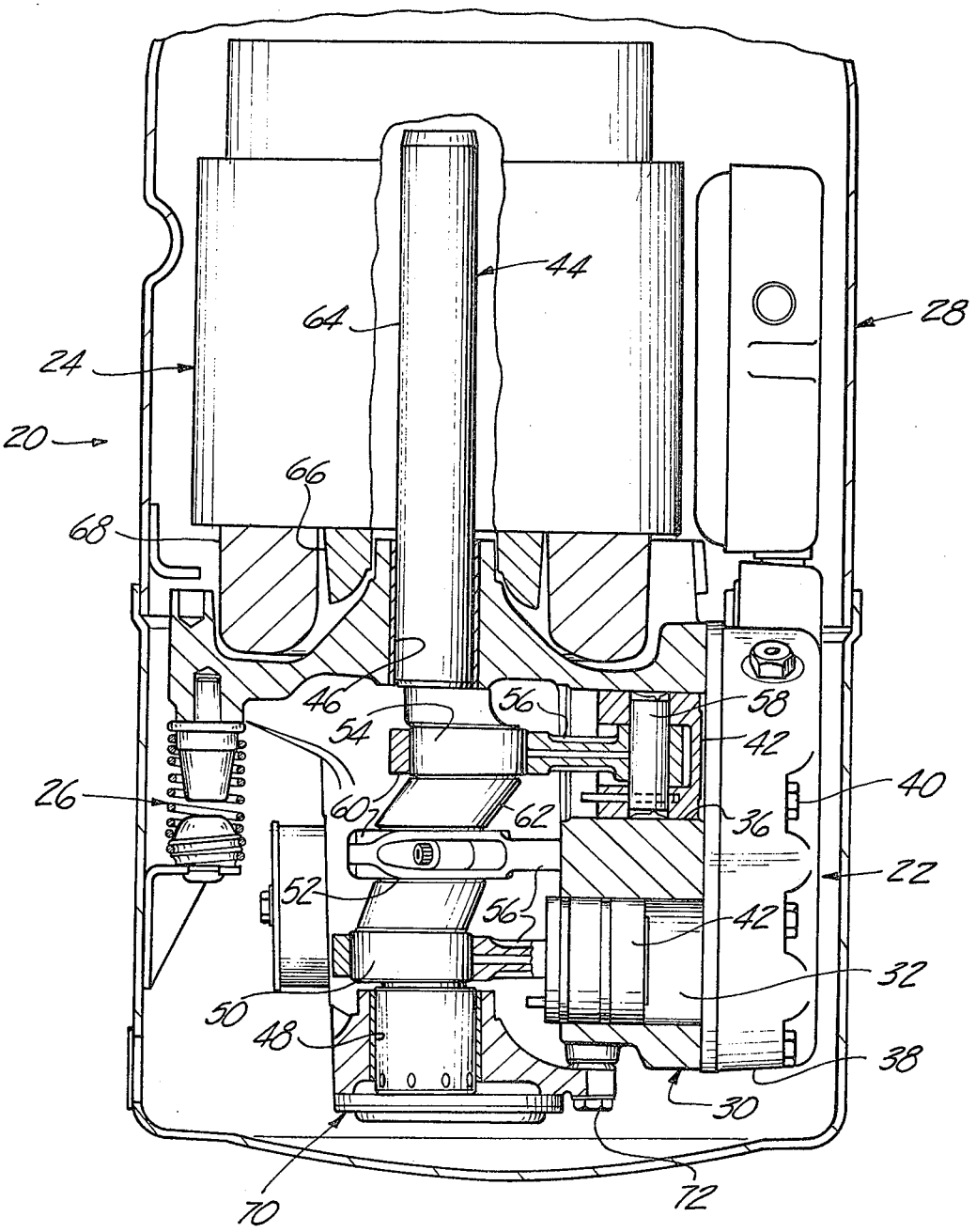
FIG. 2 is a sectional view on line 2—2 of FIG. 1.

FIGS. 1 and 2 illustrate a hermetic compressor 20 embodying this invention with a gas pump 22 and an electric motor 24 resiliently mounted by spring and bumper assemblies 26 in an outer shell 28 hermetically encasing the gas pump and electric motor. Gas pump 22 has a block 30 with three cylinders 32, 34 and 36 therein and a cylinder head 38 secured to block 30 by bolts 40.

A piston 42 is received in each cylinder for reciprocation therein by a crankshaft 44 mounted for rotation in block 30 by bushings 46 and 48 received therein. The piston 42 in each cylinder 32, 34 and 36 is operably connected with an associated crankpin 50, 52 and 54 respectively of crankshaft 44 by a connecting rod 56. Each connecting rod 56 is pivotally connected adjacent one end to an associated piston 42 by a wrist pin 58 and adjacent the other end to a crankpin on crankshaft 44 by a rod cap 60 and cap screws 62. Crankshaft 44 has an integral drive shaft 64 fixed to a rotor 66 of motor 24 which is axially received in a stator 68 of the motor. An oil pump 70 is secured by bolts 72 to one end of block 30 to supply lubricating oil under pressure through passages 74 and 76 in crankshaft 44 (FIGS. 6 and 7) to lubricate the compressor.

As shown in FIG. 1, cylinders 32, 34 and 36 are alternately positioned on opposite sides of the center line or axis of rotation 78 of crankshaft 34 with adjacent cylinders overlapping each other. The axes or center lines 80, 82 and 84 of cylinders 32, 34 and 36 respectively (FIGS. 3, 4 and 5) are parallel to each other and spced from the axis of rotation 78 of crankshaft 44, and thus, they do not intersect the axis of rotation 78. In gas pump 22 the axial center line of each wrist pin 58 intersects the axial center line of its associated piston 42 and the center lines 80, 82 or 84 of the cylinder associated with the piston. Hence, the offset of each piston 42 of gas pump 22 is the minimum distance between the axis of rotation 78 of crankshaft 44 and the center lines 80, 82 or 84 of its associated cylinder. However, it is to be understood that, if gas pump 22 is provided with pistons in which the axis of the wrist pin associated with each piston is spaced from the axial center line of the piston, the "offset" (as this term is used herein) of each piston of the gas pump would be the minimum distance between the axis of rotation 78 of crankshaft 44 and a line intersecting the axis of the wrist pin and extending parallel to the axis of the associated cylinder in which the piston is received. In gas pump 22 the piston in each cylinder 32, 34 and 36 is offset the same distance from the axis of rotation of crankshaft 44, although in some gas pumps it may be desirable to unequally offset the pistons or offset only some of the pistons. Thus, it is evident that the offset of the pistons from the axis of rotation of the crankshaft is algebraically unequal because the pistons are offset on opposite sides of the crankshaft axis of rotation or the magnitude of the offset of the pistons is unequal or both.

In accordance with a principal feature of the present invention, the centers 86, 88 and 90 of crankpins 50, 52 and 54 respectively are unequally angularly spaced about the axis 78 of crankshaft 44 as shown in FIG. 8, wherein the angles A, B, and C between the centers of the crankpins are unequal to thereby obtain symmetrically spaced torque peaks on drive shaft 64 of crankshaft 44 when gas pump 22 is driven by motor 24. The numerical values of angles A, B, and C providing a gas pump with symmetrically spaced torque peaks on the crankshaft may be calculated with the aid of a properly programmed digital computer by the following mathematical equations.

The total torque on the crankshaft of a multi-cylinder gas pump is equal to the sum of the torque contributions of each cylinder considered separately. The crankshaft torque contribution of each separate cylinder is equal to $$T = \Delta F\ R\ [\sin\theta - (\tan\Psi \cos\theta]$$

where

T = the crankshaft torque contribution of a single cylinder, $\Delta F$ = the net force acting on the piston of such single cylinder, R = the crankshaft throw of the crankpin associated with such piston, $\theta$ = the angular position of the crankpin associated with such piston, and $\Psi$ = the angle of the connecting rod associated with such piston as shown in the schematic diagram of FIG. 9.

The connecting rod angle is related to the position of its associated crankpin by the following expression:

$$\tan\Psi = -\frac{R/L \sin\theta + D/L}{\sqrt{1-(R/L \sin\theta + D/L)^2}}$$

where

L = the length between centers of the connecting rod, and

D = the offset of the piston of such cylinder from the axis of rotation of its associated crankshaft.

The net force acting on such piston is equal to the pressure of the working gas in its associated cylinder less the pressure of the gas in the crankcase acting on the piston multiplied by the area of the piston which is:

$$\Delta F = [P_\theta - P_{cc}]\pi DP^2/4$$

where $P_\theta$ = the pressure of the working gas inside the cylinder at the crankpin angular position $\theta$, $P_{cc}$ = the pressure of the gas in the crankcase acting on such piston at the crankpin angular position $\theta$, and DP = the diameter of such piston. Usually the pressure in the crankcase acting on such piston ($P_{cc}$) is substantially constant and in hermetic compressor unit is equal to the suction inlet pressure of the gas pump ($P_{SUC}$).

Assuming the compression process in the cylinder of the gas pump to be adiabatic, the pressure in the cylinder as a function of $\theta$ during the compression stroke is:

$$P_{\theta_c} = P_{\theta_{BDC}} \left[\frac{V_{\theta_{BDC}}}{V_\theta}\right]^\eta$$

where $P_{\theta_c}$ = the pressure of the working gas inside the cylinder at crankpin position $\theta$ during the compression stroke, $P_{\theta_{BDC}}$ = the pressure of the working gas inside the cylinder at the crankpin position $\theta$ where the piston is at bottom dead center, $V_\theta$ = the volume of the cylinder (including the clearance volume) at crankpin position $\theta$, $V_{\theta_{BDC}}$ = the volume of the cylinder (including the clearance volume) at the crankpin position $\theta$ where the piston is at bottom dead center, and $\eta$ = the ratio of constant pressure to constant volume specific heat at zero absolute pressure of the working gas within the cylinder.

When the calculated value of $P_{\theta_c}$ exceeds the discharge pressure ($P_{DIS}$) of the gas pump, the value of $P_{\theta_c}$ is set equal to the discharge pressure ($P_{DIS}$) since the discharge valve of the gas pump would open and the working gas would be discharged from the cylinder at such pressure (assuming an ideal pressure-volume indicator diagram) rather than being further compressed resulting in a further increase in the pressure thereof.

Assuming the expansion process in the cylinder of the gas pump to be adiabatic during the suction stroke of the piston, the pressure of the working gas in the cylinder as a function of $\theta$ during the suction stroke is:

$$P_{\theta_s} = P_{\theta_{TDC}} \left[\frac{V_{\theta_{TDC}}}{V_\theta}\right]^\eta$$

where $P_{\theta_s}$ = the pressure of the working gas inside the cylinder at crankpin position $\theta$ during the suction stroke of the piston, $P_{\theta_{TDC}}$ = the pressure of the working gas inside the cylinder at the crankpin position of $\theta$ where the piston is at top dead center, and $V_{\theta_{TDC}}$ = the volume of the cylinder (including the clearance volume) at the crankpin position of $\theta$ where the piston is at top dead center; i.e., the minimum volume of the cylinder which is equal to the clearance volume.

When the calculated value of $P_{\theta_s}$ is less than the suction or inlet pressure ($P_{SUC}$) of the gas pump, the value of $P_{\theta_s}$ is set equal to the suction pressure ($P_{SUC}$) since the inlet valve of the gas pump would be open (assuming an ideal pressure-volume indicator diagram); and hence, the pressure within the cylinder would not decrease below the suction pressure.

The volume of the cylinder as a function of the angular position of the crankpin ( $V_\theta$ ) assuming adiabatic compression and expansion is given by the expression:

$$V_\theta = \frac{\pi DP^2}{4}[\sqrt{(L+R)^2 - D^2} - (R\cos\theta - L\cos\Psi)] + V_{CL}$$

where $V_{CL}$ = the clearance volume of the cylinder, and $$\cos\Psi = -\sqrt{1 - [R/L \sin\theta + D/L]^2}$$

This expression for $V_\theta$ may be used to determine $V_{\theta_{TDC}}$ and $V_{\theta_{BDC}}$ in calculating $P_\theta$ since the value of $\theta$ in radians when the piston is at top dead center ($\theta_{TDC}$) is given by $$\theta_{TDC} = 2\pi - \tan^{-1}[D/\sqrt{(L+R)^2 - D^2}]$$

and the value of $\theta$ in radians when the piston is at bottom dead center ($\theta_{BDC}$) is given by $$\theta_{BDC} = \pi - \tan^{-1}[D/\sqrt{(L-R)^2 - D^2}]$$

These expressions for $\theta_{TDC}$ and $\theta_{BDC}$ are derived from the geometry of FIG. 9 when R is colinear with L and extends beyond (TDC) or overlies (BDC) L respectively.

If the angular relationship of the crankpins of a multiple cylinder gas pump to a fixed reference on the crankshaft were known; i.e., $$\theta_1 = \theta$$

$$\theta_n = \theta + \Delta\theta_n$$

where $\theta_1$ = the angular position of the crankpin associated with the first cylinder to a fixed reference point on the crankshaft, $\theta_n$ = the angular position of the crankpin associated with the Nth cylinder to such fixed reference point on the crankshaft, $\Delta\theta_n$ = the angle between the positions of the crankpins associated with the first and the Nth cylinder, and $\theta$ = the angular position of the fixed reference point on the crankshaft as the crankshaft is rotated.

these equations could be solved to determine the torque contribution at the crankshaft of each cylinder at any angular position of the crankshaft ($T_{\theta_n}$) and the sum of the torque contributions of each cylinder wll equal the total torque on the crankshaft at any angular position thereof ($T_{\theta_{total}}$); i.e., $$T_{\theta_{total}} = T_{\theta_1} + T_{\theta_2} \ldots\ldots\ldots + t_{\theta_n}$$

Since these equations contain several unknowns ($T_{\theta_n}$ and $\Delta\theta_1$ through $\Delta\theta_n$), they require an iterative solution of one form or another. Thus, it is convenient to use a properly programmed digital computer to calculate the total torque ($T_{\theta_{total}}$) at 2° increments throughout one complete revolution of the crankshaft; i.e., $\theta$ = 0°, 2°, 4°, ..... 358°, 360° with selected values of $\Delta\theta_1$ through $\Delta\theta_n$ and observe the locations at which the total torque obtains relative maximum or peaks. By iterative solution of these equations with new, more proximate values of $\Delta\theta_1$ through $\Delta\theta_n$ selected in light of the immediately preceding calculated locations of the total torque peaks, the angular spacing of the crankpins on the crankshaft ($\theta_1$, $\theta_2$, ..... $\theta_n$) producing equal angularly spaced torque peaks throughout each revolution of the crankshaft can be rapidly calculated within about 1°, which is sufficiently accurate to produce a practical and commercially acceptable gas pump. In a multicylinder gas pump there is one relative maximum or peak of the total torque for each cylinder per revolution of the crankshaft.

A convenient procedure for selecting values of $\Delta\theta_1$ through $\Delta\theta_n$ to be used in an iterative solution of these equations is to calculate the torque contribution of each cylinder ($T_{\theta_1}, T_{\theta_2}, \ldots, T_{\theta_n}$) and the total torque on the crankshaft ($T_{\theta\ total}$) for one complete revolution of the crankshaft, assuming the crankpins are symmetrically or equally spaced about the axis of the crankshaft. By examining a graph or plot of the total torque through one complete revolution of the crankshaft and the points at which the torque contribution of each individual cylinder peaks, an improved approximation of the correct angular spacing of the crankpins to provide symmetrically spaced torque peaks on the crankshaft can be determined. For example, a particular three-cylinder gas pump constructed generally in accordance with FIGS. 1 through 8 of the drawings has a calculated total torque on the crankshaft in one revolution thereof as shown in FIG. 11 under the assumption of symmetrical crankpin spacing on the crankshaft; i.e., 120° between the centers of the crankpins. The calculated peaks 92, 94 and 96 of the total torque for the gas pump of this example are at 42°, 190° and 286° respectively (FIG. 11) and the calculated peaks of the torque contribution thereto of the individual cylinders 36, 34 and 32 are at 42°, 190° and 282° respectively when the crankpins are symmetrically spaced on the crankshaft. Thus, the angular positions of the total torque peaks 92, 94 and 96 in one revolution of the crankshaft substantially correspond with the angular positions of the peaks of the torque contributions of the individual cylinders 36, 34 and 32 respectively; and torque peaks 92 and 96 are already substantially correctly spaced about the crankshaft since they are 244° apart and would be 240° apart if symmetrically spaced. Thus, it is necessary to select a new value for only the angular location of crankpin 52 associated with cylinder 34 to symmetrically position torque peak 94 on the crankshaft between torque peaks 92 and 96. Since the angular spacing between torque peaks 92 and 96 and crankpins 54 and 50 of the corresponding cylinders 36 and 32, is in a ratio of substantially one-to-one; a good approximation of the number of degrees that the crankpin 52 of cylinder 34 should be moved on the crankshaft from its symmetrical location is the number of degrees torque peak 94 should be shifted to be symmetrically positioned between torque peaks 92 and 96. If torque peak 94 were shifted 26°, it would be centered between torque peaks 92 and 96 at 164° and, hence, a good approximation of the proper location of crankpin 52 is 26° from its symmetrical position. Solution of these equations with crankpins 50 and 54 located in their symmetrical positions and crankpin 52 shifted 26° from its symmetrical position results in peaks in the calculated total torque per revolution of the crankshaft occurring at 42°, 164°, and 282°. Thus, when crankpin 52 is shifted 26°, the first and third peaks of the total torque are symmetrically spaced apart and the second peak is 2° away from its symmetrical position. If crankpin 52 is shifted two more degrees so that it would be located 28° from its symmetrical position, solution of these equations results in a calculated total torque on the crankshaft throughout one revolution thereof with symmetrically spaced torque peaks 92', 94' and 96' occurring at 42°, 162° and 282° respectively as shown in FIG. 10 of the drawings. When the crankpin of cylinder 34 is shifted 28° from its symmetrical position, the angles A, B and C (FIG. 8) between the centers of the crankpins are 148°, 92° and 120° respectively.

The particular compressor of this example has a diameter for each piston of 1.781 inches, an offset of each piston center line from the crankshaft axis of rotation of 0.6865 inches, a crankshaft throw for each crankpin of 0.490 inches, and a distance between the centers for each connecting rod of 2.6745 inches. The calculations of this example are based on a discharge pressure of 296 pounds per square inch gauge, a suction pressure of 76 pounds per square inch gauge, and R-22 working gas. An actual gas pump constructed in accordance with the dimensions of this example, when operating with the suction and discharge pressures thereof, has been found to have symmetrically (equally) spaced torque peaks on the crankshaft. The symmetrical spacing of the torque peaks has been checked by driving the gas pump with an electric motor and monitoring the wave form of the electric current energizing the motor to determine the symmetrical spacing of the wave form of such electric current. Rotating shaft torque sensors manufactured and sold by Lebow Associates, Inc., 21820 Wyoming, Oak Park, Michigan, 48237, may also be used to sense the torque demand at the crankshaft of this gas pump when driven by a dynamometer.

The amplitudes of the peaks of the total torque on the crankshaft of this gas pump are unequal as shown in FIG. 10 and can be equalized by decreasing the volume of cylinder 34 relative to cylinders 32 and 36. It is believed that by so equalizing the amplitude of the torque peaks, a further decrease in the operating noise and vibration of the gas pump will be obtained.

In accordance with another feature of this invention, the overall efficiency of expansible chamber devices is improved by turning the crankpins for more than half and preferably all of the offset pistons of the device in a preferred direction of rotation. In a gas pump the overall efficiency is improved by turning the crankshaft so that each of more than half and preferably all of the crankpins associated with an offset piston approaches closest to or passes through the center line of the cylinder associated with the offset piston during the compression stroke of such offset piston. In a multiple cylinder gas pump 100, only one cylinder of which is semi-schematically illustrated in FIG. 12, the preferred direction of rotation of crankpin 102 associated with each offset piston 104 is therefore counter-clockwise as indicated by arrow 106. Offset piston 104 is received for reciprocation in a cylinder 106 with a center line 108 which is coaxial with the center line of piston 104 and intersects the axis of wrist pin 108 thereof. Crankpin 102 is operably connected with offset piston 104 by a connecting rod 110 and is an integral part of a crankshaft 112 which, in turn, is rotatable about an axis 114. As will be seen from FIG. 12, when crankpin 102 of crankshaft 110 turns or revolves counter-clockwise in its preferred direction of rotation or revolution in accordance with the present invention, the crankpin passes through center line 108 of offset piston 104 during the compression stroke of the piston.

In a reciprocating internal combustion engine the overall efficiency is improved by rotating the crankshaft so that each of more than half and preferably all of the crankpins associated with an offset piston approaches closest to or passes through the center line of the cylinder associated with the offset piston during the power stroke of such offset piston. In a multiple cylinder internal combustion engine 116, only one cylinder of which is semi-schematically illustrated in FIG. 13, the preferred direction of rotation of the crankpin 118 associated with each offset piston 120 is, therefore, clockwise as indicated by arrow 122. Offset piston 120 is received for reciprocation in a cylinder 124 with a center line 126 which is coaxial with the center line of offset piston 120 and intersects the axis of wrist pin 128 thereof. Crankpin 118 is operably connected with offset piston 120 by a connecting rod 130 and is an integral part of a crankshaft 132 with an axis of rotation 134. As will be seen from FIG. 13, when crankpin 118 of crankshaft 132 turns clockwise in its preferred direction of rotation, the crankpin passes through center line 126 during the power stroke of the piston.

If all the offset pistons in an expansible chamber device are located on the same side of the axis of rotation of the crankshaft thereof, the crankpin associated with each offset piston may turn in its preferred direction of rotation. However, if offset pistons are located on both sides of the axis of rotation of the crankshaft of an expansible chamber device, only the crankpins associated with the offset pistons on one side of the axis of rotation of the crankshaft may turn in their preferred direction of rotation. Hence, to improve the efficiency of such an expansible chamber device more than half of all of the offset pistons thereof must be located on one side of the axis of rotation of the crankshaft thereof. For example, in gas pump 22 the offset pistons received in cylinders 32 and 36 are located on one side of the axis of rotation 78 of crankshaft 44 and the offset piston received in cylinder 34 is located on the other side of the center line of the crankshaft. Thus, the preferred direction of rotation of crankshaft 44 is counterclockwise as viewed from the drive shaft end thereof to provide increased overall efficiency of gas pump 22. When gas pump 22 is driven in this preferred direction of rotation, its overall efficiency is increased compared both to driving the gas pump in the opposite or clockwise direction and to a gas pump without offset pistons but otherwise identical with gas pump 22. The improved overall efficiency of gas pump 22 when crankshaft 44 is driven in a counter-clockwise direction compared to being driven in a clockwise direction has been experimentally verified.

Multiple cylinder expansible chamber devices, such as gas pumps and internal combustion engines with offset pistons embodying this invention, may have blocks with staggered cylinders providing devices of compact size and economical manufacture and assembly. By utilizing offset pistons associated with a crankshaft with asymmetrically or unequally spaced crankpins thereon, this invention provides an expansible chamber device with decreased noise and vibration in operation. This invention also provides increased overall efficiency by a preferred direction of rotation of the crankpins associated with more than half and preferably all of the offset pistons of an expansible chamber device.

I claim:

1. An expansible chamber device having at least two pistons each individually received in an associated cylinder, a crankshaft having at least two separate crankpins operably connected with said pistons for reciprocal movement thereof in an associated cylinder in conjunction with rotary movement of said crankshaft, at least one of said pistons being offset from the axis of rotation of said crankshaft such that the center line of the cylinder associated with said one piston does not intersect the axis of rotation of said crankshaft, the axis of rotation of said crankshaft being located between the center lines of said cylinders such that there are center lines of cylinders on both sides of the axis of rotation of said crankshaft, said crankpins being constructed and arranged on said crankshaft with an asymmetrical angular spacing with respect to each other about the axis of rotation of said crankshaft such that no two pistons on opposite sides of the axis of rotation of said crankshaft will reach top dead center at the same time and also such that the peaks in the total torque on said crankshaft about its axis of rotation are substantially symmetrically angularly spaced throughout the revolution of said crankshaft.

2. The expansible chamber device of claim 1 wherein said crankshaft has one crankpin for each piston and each crankpin is operably connected with only one piston for reciprocal movement thereof in an associated cylinder in conjunction with rotary movement of said crankshaft.

3. The expansible chamber device of claim 2 wherein said crankpins are asymmetrically angularly spaced on said crankshaft such that only one piston at a time will reach top dead center.

4. The expansible chamber device of claim 1 wherein each of said pistons is offset from the axis of rotation of said crankshaft.

5. The expansible chamber device of claim 4 wherein the magnitude of the offset of each of said pistons from the axis of rotation of said crankshaft is equal.

6. The expansible chamber device of claim 4 wherein adjacent cylinders on opposite sides of the axis of rotation of said crankshaft are overlapped and staggered with respect to each other.

7. An expansible chamber device having at least two pistons each individually received in an associated cylinder, a crankshaft having at least two separate crankpins, connecting rods operably connected with said pistons and crankpins for reciprocal movement of each of said pistons in an associated cylinder in conjunction with rotary movement of said crankshaft, at least one of said pistons being offset from the axis of rotation of said crankshaft such that a line intersecting the center of the connection of said one piston with its associated rod and extending parallel to the center line of the cylinder associated with said one piston does not intersect the axis of rotation of said crankshaft, the algebraic value of the offsets of at least two of said pistons from the axis of rotation of said crankshaft being unequal, said crankpins being constructed and arranged on said crankshaft with an asymmetrical angular spacing with respect to each other about the axis of rotation of said crankshaft such that no two pistons on opposite sides of the axis of rotation of said crankshaft will reach top dead center at the same time and also such that the peaks in the total torque on said crankshaft about its axis of rotation are substantially symmetrically angularly spaced throughout the revolution of said crankshaft.

8. The expansible chamber device of claim 7 wherein each of said pistons is offset from the axis of rotation of said crankshaft and said crankpins are asymmetrically angularly spaced on said crankshaft such that only one piston at a time will reach top dead center.

9. A gas pump having at least two pistons each individually received in an associated cylinder, a connecting rod pivotally connected adjacent one end to each of said pistons, a crankshaft adapted to be driven by a prime mover and having at least two separate crankpins operably connected through said rods with said pistons for reciprocal movement of each of said pistons in an associated cylinder in conjunction with rotary movement of said crankshaft, at least one of said pistons being offset from the axis of rotation of said crankshaft such that a line intersecting the axis of the pivotal connection of said one piston with its associated connecting rod and extending parallel to the centerline of the cylinder associated with said one piston is spaced from and does not intersect the axis of rotation of said crankshaft, said crankshaft being located between the centerlines of said cylinder such that there are centerlines of cylinders on both sides of the axis of rotation of said crankshaft, said crankpins being constructed and arranged on said crankshaft with an asymmetrical angular spacing with respect to each other about the axis of rotation of said crankshaft such that only one piston at a time will reach top dead center and also such that the peaks in the total torque about the axis of rotation of said crankshaft supplied thereto by a prime mover are substantially symmetrically angularly spaced throughout each complete revolution of said crankshaft.

10. The gas pump of claim 9 which also comprises an electric motor directly connected with said crankshaft of said gas pump, and an outer shell hermetically encasing both said gas pump and said electric motor.

11. The gas pump of claim 9 wherein each of said pistons is offset from the axis of rotation of said crankshaft.

12. The gas pump of claim 9 wherein said crankshaft has one crankpin for each piston and each crankpin is operably connected with only one piston for reciprocal movement of said one piston in an associated cylinder in conjunction with rotary movement of said crankshaft.

13. The gas pump of claim 12 wherein each of said pistons is offset from the axis of rotation of said crankshaft such that a line intersecting the axis of the pivotal connection of each piston with its associated connecting rod and extending parallel to the centerline of the cylinder associated with each piston is spaced from and does not intersect the axis of rotation of said crankshaft.

14. The gas pump of claim 13 wherein the magnitude of the offset of each of said pistons from the axis of rotation of said crankshaft is equal.

15. The gas pump of claim 13 wherein adjacent cylinders with centerlines on opposite sides of the axis of rotation of said crankshaft are overlapped and staggered with respect to each other.

16. The gas pump of claim 15 which also comprises an electric motor directly connected with said crankshaft of said gas pump, and an outer shell hermetically encasing both said gas pump and said electric motor.

17. The gas pump of claim 16 wherein adjacent cylinders with centerlines on opposite sides of the axis of rotation of said crankshaft are overlapped and staggered with respect to each other.

18. The expansible chamber device of claim 2 wherein each of said pistons is offset from the axis of rotation of said crankshaft.

19. The expansible chamber device of claim 7 wherein said crankshaft has one crankpin for each piston and each crankpin is operably connected with only one piston for reciprocal movement thereof in an associated cylinder in conjunction with rotary movement of said crankshaft.

20. The expansible chamber device of claim 1 wherein the cylinders on opposite sides of the axis of rotation of said crankshaft are arranged and constructed with unequal volumes such that the maximum amplitude of each of the peaks in the total torque on said crankshaft about its axis of rotation are substantially equal.

21. The expansible chamber device of claim 7 wherein the cylinders of pistons with algebraically unequal offsets are constructed and arranged with unequal volumes such that the maximum amplitude of each of the peaks in the total torque on said crankshaft about its axis of rotation are substantially equal.

22. The gas pump of claim 9 wherein the cylinders on opposite sides of the axis of rotation of said crankshaft are constructed and arranged with unequal volumes such that the maximum amplitude of each of the peaks in the total torque on said crankshaft about its axis of rotation are substantially equal.

23. The expansible chamber device of claim 1 wherein adjacent cylinders on opposite sides of the axis of rotation of said crankshaft are overlapped and staggered with respect to each other.

24. The expansible chamber device of claim 2 wherein adjacent cylinders on opposite sides of the axis of rotation of said crankshaft are overlapped and staggered with respect to each other.

25. The expansible chamber device of claim 7 wherein the cylinders of adjacent pistons having algebraically unequal offsets are overlapped and staggered with respect to each other.

26. The expansible chamber device of claim 19 wherein the cylinders of adjacent pistons having algebraically unequal offsets are overlapped and staggered with respect to each other.

27. The gas pump of claim 9 wherein adjacent cylinders on opposite sides of the axis of rotation of said crankshaft are overlapped and staggered with respect to each other.

28. The gas pump of claim 12 wherein adjacent cylinders on opposite sides of the axis of rotation of said crankshaft are overlapped and staggered with respect to each other.

* * * * *

UNITED STATES PATENT OFFICE
CERTIFICATE OF CORRECTION

PATENT NO. : 3,985,475
DATED : October 12, 1976
INVENTOR(S) : George W. Gatecliff It is certified that error appears in the above-identified patent and that said Letters Patent are hereby corrected as shown below:

Column 10, line 54: "15" should be --13--

Signed and Sealed this
Third Day of May 1977

[SEAL]

*Attest:*

RUTH C. MASON
*Attesting Officer*

C. MARSHALL DANN
*Commissioner of Patents and Trademarks*